US011148172B2

(12) United States Patent
Ulrich et al.

(10) Patent No.: US 11,148,172 B2
(45) Date of Patent: Oct. 19, 2021

(54) ITEM SORTING SYSTEM AND METHOD OF SORTING

(71) Applicant: JR Automation Technologies, LLC, Holland, MI (US)

(72) Inventors: Craig Ulrich, Clarkston, MI (US); Matt Cagle, Oxford, MI (US); Ryan Lute, West Bloomfield, MI (US); Kyle Christian, Clarkston, MI (US); Jason Hodgins, Clio, MI (US); Bret Slocum, Lake Orion, MI (US); Marc Walters, Lake Orion, MI (US)

(73) Assignee: JR Automation Technologies, LLC, Holland, MI (US)

( * ) Notice: Subject to any disclaimer, the term of this patent is extended or adjusted under 35 U.S.C. 154(b) by 0 days.

(21) Appl. No.: 16/725,982

(22) Filed: Dec. 23, 2019

(65) Prior Publication Data

US 2020/0269283 A1 Aug. 27, 2020

Related U.S. Application Data

(60) Provisional application No. 62/784,397, filed on Dec. 22, 2018.

(51) Int. Cl.

| | |
|---|---|
| ***B07C 5/36*** | (2006.01) |
| ***B07C 3/08*** | (2006.01) |
| ***B07C 3/00*** | (2006.01) |

(52) U.S. Cl.
CPC ..... *B07C 3/08* (2013.01); *B07C 3/008* (2013.01)

(58) Field of Classification Search
CPC .. B07C 3/08; B07C 3/008; B07C 3/06; B07C 2501/0063; B65G 47/46; B25J 9/0093; B25J 9/0096; B25J 15/0019; B25J 15/0033; G05B 19/4182
USPC ..... 209/606
See application file for complete search history.

(56) References Cited

U.S. PATENT DOCUMENTS

2015/0073589 A1* 3/2015 Khodl ..... B65G 1/1378 700/218
2017/0225330 A1* 8/2017 Wagner ..... B25J 9/1694

* cited by examiner

*Primary Examiner* — Charles A Fox
*Assistant Examiner* — Molly K Devine
(74) *Attorney, Agent, or Firm* — The Watson IP Group, PLC; Jovan N. Jovanovic

(57) ABSTRACT

An item sorting system having a tray handling system and a tote handling system. The tray handling system having a tray conveying system, a tray transfer system, and optionally a tray storage region. The tote handling system may have a cubby array, the cubby array having a plurality of cubbies into which a tote may be placed. The system can transfer an item from the tray into the tote, and a method is disclosed for the same.

17 Claims, 16 Drawing Sheets

ITEM SORTING SYSTEM AND METHOD OF SORTING

CROSS-REFERENCE TO RELATED APPLICATION

This application claims priority from U.S. Provisional Patent Application Ser. No. 62/784,397 filed Dec. 22, 2018, entitled "Item Sorting System and Method of Sorting," the entire specification of which is hereby incorporated by reference in its entirety.

BACKGROUND OF THE DISCLOSURE

1. Field of the Disclosure

The disclosure relates in general to sorting of items, and more particularly, to a system that is configured to sort all types of items, as well as a method of sorting. While not limited thereto, it is contemplated that the system may be used in the packaging, shipping and/or distribution fields.

2. Background Art

With the increase of delivered goods and products, there has been an increase in the demand for efficient sorting equipment, that can, for example, sort items for eventual shipping and/or delivery. Many of the current systems rely on large conveyors and conveying systems, or, in smaller scale, rely on operators and manual labor for sorting as well as processes that may occur after sorting.

Problematically, the use of operators and manual labor generally limits throughput and tends to have high costs while being error prone. The larger systems, while generally scalable in an upward direction, become cumbersome when the quantity of items to be sorted are smaller (i.e., on the order of 1500-2500 items per hour, for example). The large scale conveyor systems are generally optimized for sorting operations of tens of thousands of packages or items per hour. Thus, there is a gap between the manual sorting and the large systems which are inefficient at smaller volumes.

Additionally, and problematically, many types of products are difficult to handle by automated equipment. Among the type of products that are difficult to handle include round or cylindrical items that can roll or slide on surfaces as the surfaces are moved or inclined.

SUMMARY OF THE DISCLOSURE

The disclosure is directed, in one aspect, to a sorting system. The sorting system includes at least a tray handling system and a tote handling system. The tray handling system may include a tray conveying system, a tray transfer system, and optionally a tray storage region. The tote handling system may have a cubby array, the cubby array having a plurality of cubbies into which a tote may be placed. The system can transfer an item from the tray into the tote.

In another aspect, the disclosure is directed to a tool for use in association with a robot arm for sorting. The tool includes, at least, a frame, an upper tray attachment assembly and a lower tray attachment assembly, and optionally, a tray cover.

In another aspect of the disclosure, the disclosure is directed to a tray for a sorting system. The tray comprises an upper portion, a lower portion and a slidable coupling attaching the upper portion to the lower portion so as to be slidable relative to each other. Each of the upper portion and the lower portion include attachment assemblies that are configured to allow attachment of the tray to a tool that is coupled to a robot.

In yet another aspect of the disclosure, the disclosure is directed to a method of sorting. The method includes, at least the steps of: placing an item into a tray; providing a tote; and transferring the item from the tray into the tote with a tool on a robotic arm.

In greater detail, the disclosure is directed to an item storing system. The item storing system includes a tray handling system and a tote handling system. The tray handling system includes a tray conveying system and a tray transfer system. The tray conveying system defines a conveyor having a filling region, a pick-up region and a return region. The tray transfer system has a robotic arm assembly and a tray handling tool wherein the tray handling tool is positioned at an end of the robotic arm, the tray handling tool structurally configured to retain a tray. The tote handling system includes at least one cubby structurally configured to retain a tote.

In some configurations, the tray handling tool can move between a pick-up region and the at least one cubby.

In some configurations, the tray handling tool can be positioned within the at least one cubby.

In some configurations, the tray handling tool further comprises an upper tray attachment assembly and a lower tray attachment assembly. The lower tray attachment assembly can be moved relative to the upper tray attachment assembly when the tray handling tool is positioned within the at least one cubby.

In some configurations, the at least one cubby has an entry opening and an exit opening opposite the entry opening. The robotic arm has access to the entry opening.

In some configurations, the at least one cubby comprises a cubby array having at least a plurality of rows and a plurality of columns of cubbies.

In some configurations, the conveyor further includes a queued region within which the pick-up region is defined.

In another aspect of the disclosure, the disclosure is directed to a tool for use in association with a robot arm for item sorting. The tool comprises a frame, an upper tray attachment assembly and a lower tray attachment assembly. The frame is attachable to a robot arm. The upper tray attachment assembly is coupled to the frame. The lower tray attachment assembly is coupled to the frame. The upper tray attachment assembly and the lower tray attachment assembly being are slidably relative to each other.

In some configurations, the upper tray attachment assembly includes at least one slot engaging prong structurally configured to releasably couple with an upper portion of a tray. The lower tray attachment assembly includes at least one lower slot engaging prong structurally configured to releasably couple with a lower portion of a tray. The slidable movement assembly includes an actuator coupled to at least one lower slot engaging prong, so as to slidably move the lower tray attachment assembly relative to the upper tray attachment assembly.

In some configurations, the slidable movement assembly includes at least one guide that is coupled to the at least one slot engaging prong and to the actuator.

In some configurations, the upper tray attachment assembly includes opposing articulated pin grasping arms movable by an actuator. The articulated pin grasping arms are structurally configured to releasably couple with pins of the upper portion of the tray.

In some configurations, the articulated pin grasping arms extend inwardly and outwardly in a direction that is perpendicular to the slidable movement of the upper tray attachment assembly relative to the lower tray attachment assembly.

In some configurations, the tool further includes a tray cover extending from the upper tray attachment assembly and fixed thereto.

In some configurations, the tray cover includes a top wall, opposing side walls depending from the top wall and a front lip depending from the top wall spanning between the opposing side walls.

In yet another aspect of the disclosure, the disclosure is directed to a tray for an item sorting system comprising an upper portion, a lower portion, and a slidable coupling assembly. The upper portion is defined by a front wall, a back wall and a plurality of sidewalls defining a cavity with an upper opening and a lower opening. The lower portion includes a base that can generally extend over the lower opening to preclude the passage of an object therethrough. The slidable coupling assembly is coupled to each of the upper portion and the lower portion to enable slidable movement of the upper portion relative to the lower portion.

In some configurations, the tray further includes a lower portion attachment member and an upper portion attachment member. The lower portion attachment member is structurally configured to engage a lower tray attachment assembly. The upper portion attachment member is structurally configured to engage an upper tray attachment assembly.

In some configurations, the lower portion attachment member comprises a slot. In some configurations, the upper portion attachment member comprises at least one of a slot and at least one pin. In still other configurations, the upper portion attachment member comprises each one of a slot and a pair of spaced apart pins extending from the front wall.

In some configurations, the lower portion further includes opposing sidewalls and a front wall, with the opposing sidewalls overlying the plurality of sidewalls of the upper portion of the tray and the front wall overlying the front wall of the upper portion.

BRIEF DESCRIPTION OF THE DRAWINGS

The disclosure will now be described with reference to the drawings wherein.

DETAILED DESCRIPTION OF THE DISCLOSURE

Figure 1:
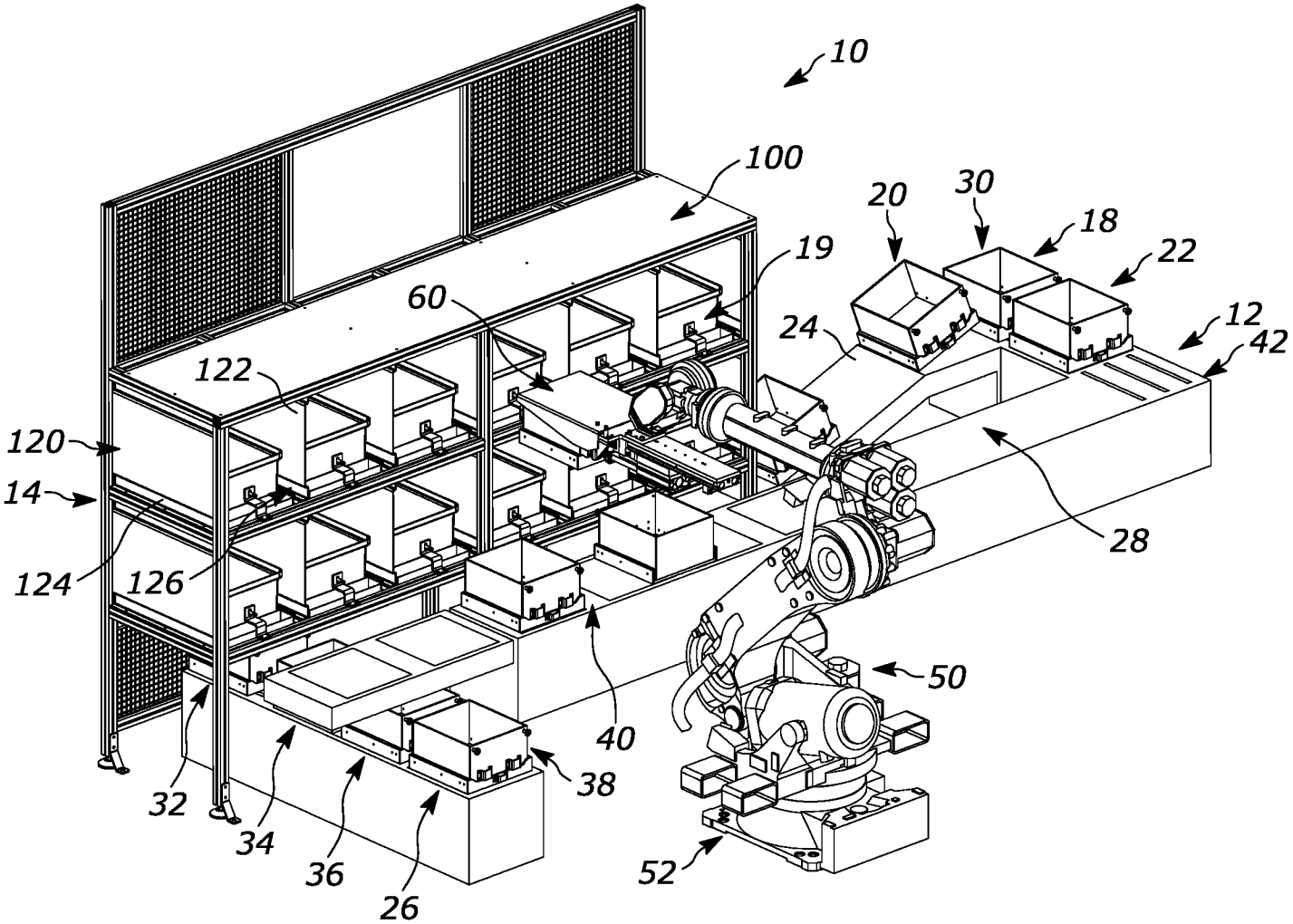
FIG. 1 of the drawings is a perspective view of the item sorting system of the present disclosure.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIGS. 1 through 4, the item sorting system is referred to generally at 10. As will be explained below, the item sorting system is configured to receive items in a tray, such as tray 18 and to transfer items from the tray to a tote, such as tote 19. In the configuration shown, it is contemplated that operators place the items in the respective trays, and that operators remove filled totes from the tote handling system 14. In other configurations, additional automation may be presented to, in an automated fashion, fill empty trays, and remove full totes.

In the configuration shown, the system 10 is shown as having a single tray transfer system 50, which then defines a single cell (that is depicted in FIGS. 1 through 4). It is contemplated that a plurality of cells such as three, and that they may be positioned in a linear fashion, among other orientations. That is, the tray handling system can direct a tray to the proper one of the three different cells, for handling by one of three different robotic arms. It has been determined that a group of three cells can handle 1500 sortations an hour in the configuration shown. It will be understood that this is merely exemplary and not to be deemed limiting. Of course, further expansion is contemplated beyond three cells, and, it is also contemplated that an installation may have other expansion configurations.

Figure 6:
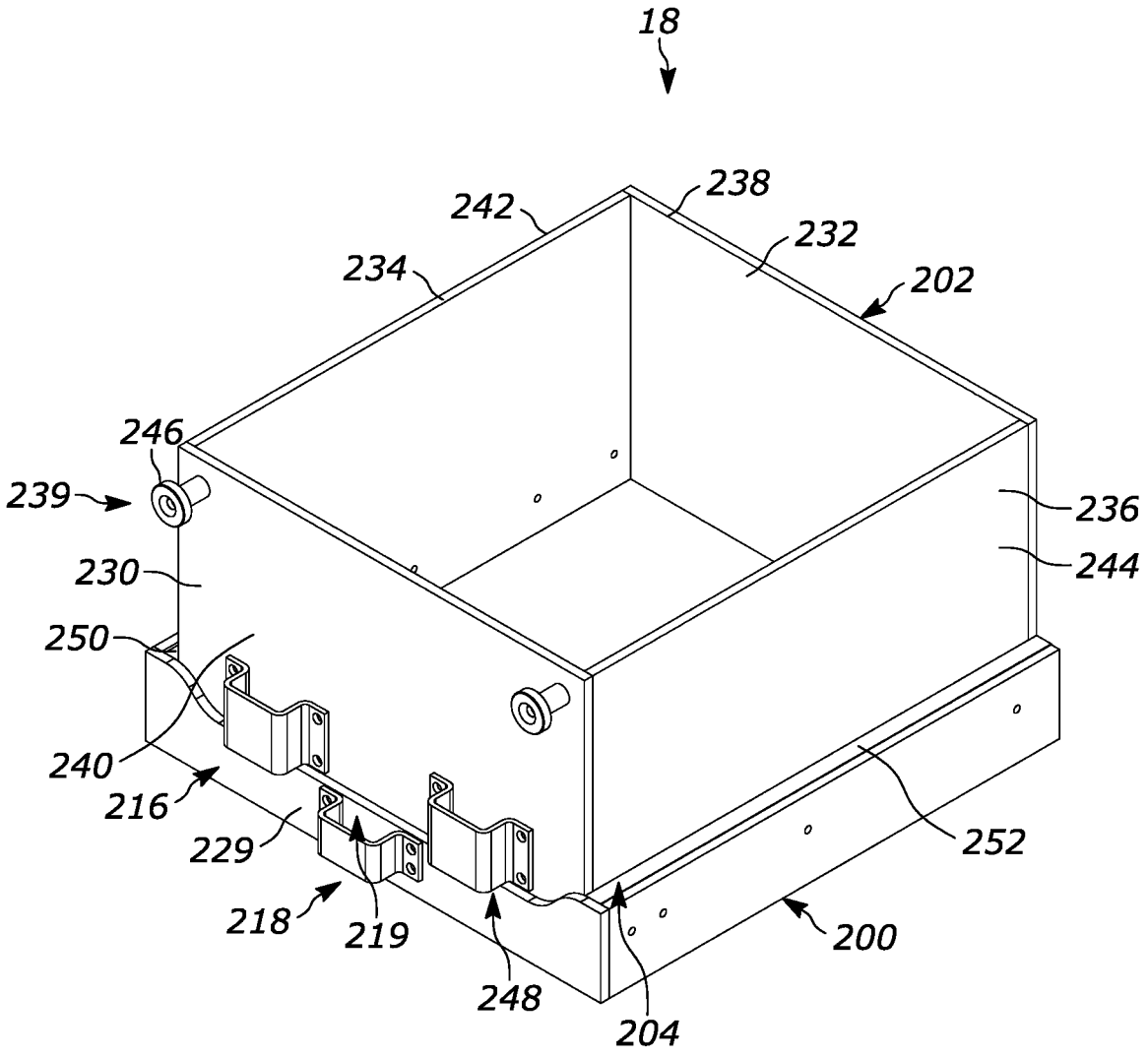
FIG. 6 of the drawings is a perspective view of an exemplary tray used with the item sorting system of the present disclosure, with the understanding that the tray, its dimensions and configuration are merely exemplary.
Figure 7:
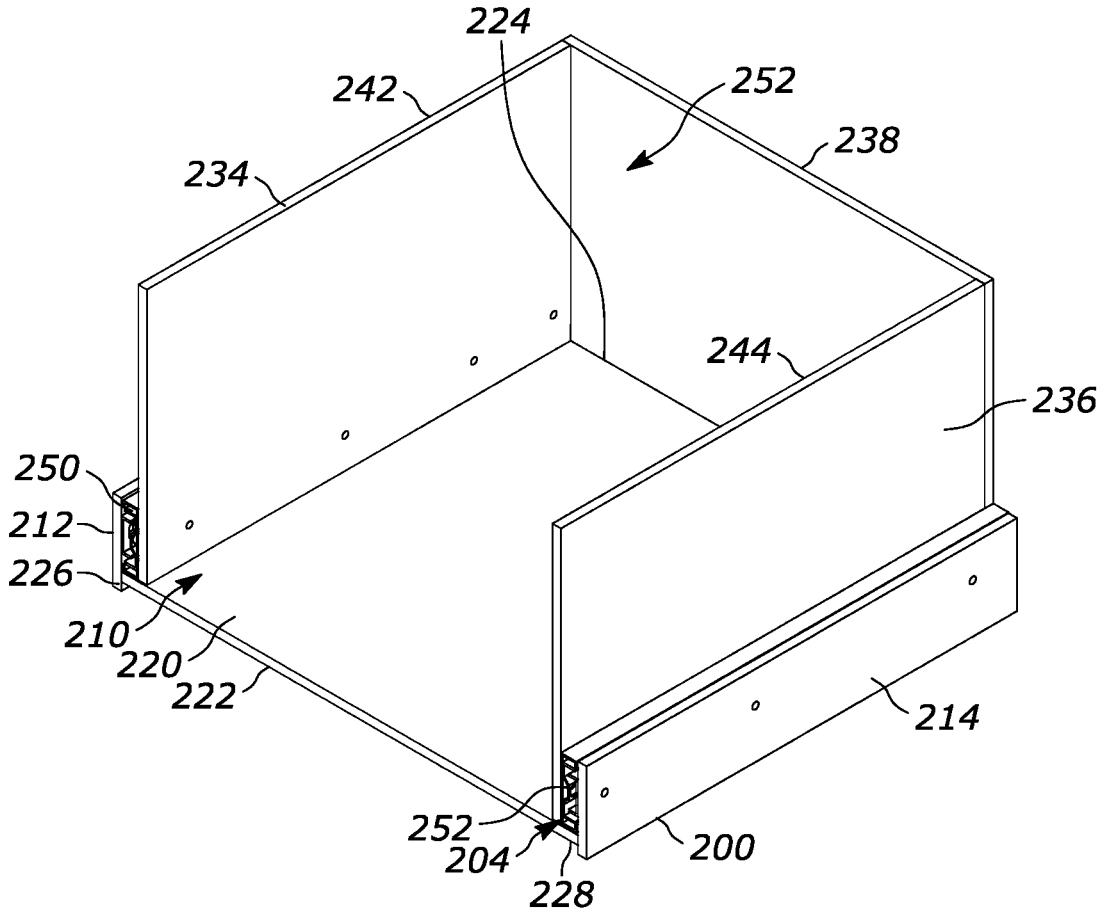
FIG. 7 of the drawings is perspective cross-sectional view of the exemplary tray of FIG. 6.
Figure 8:
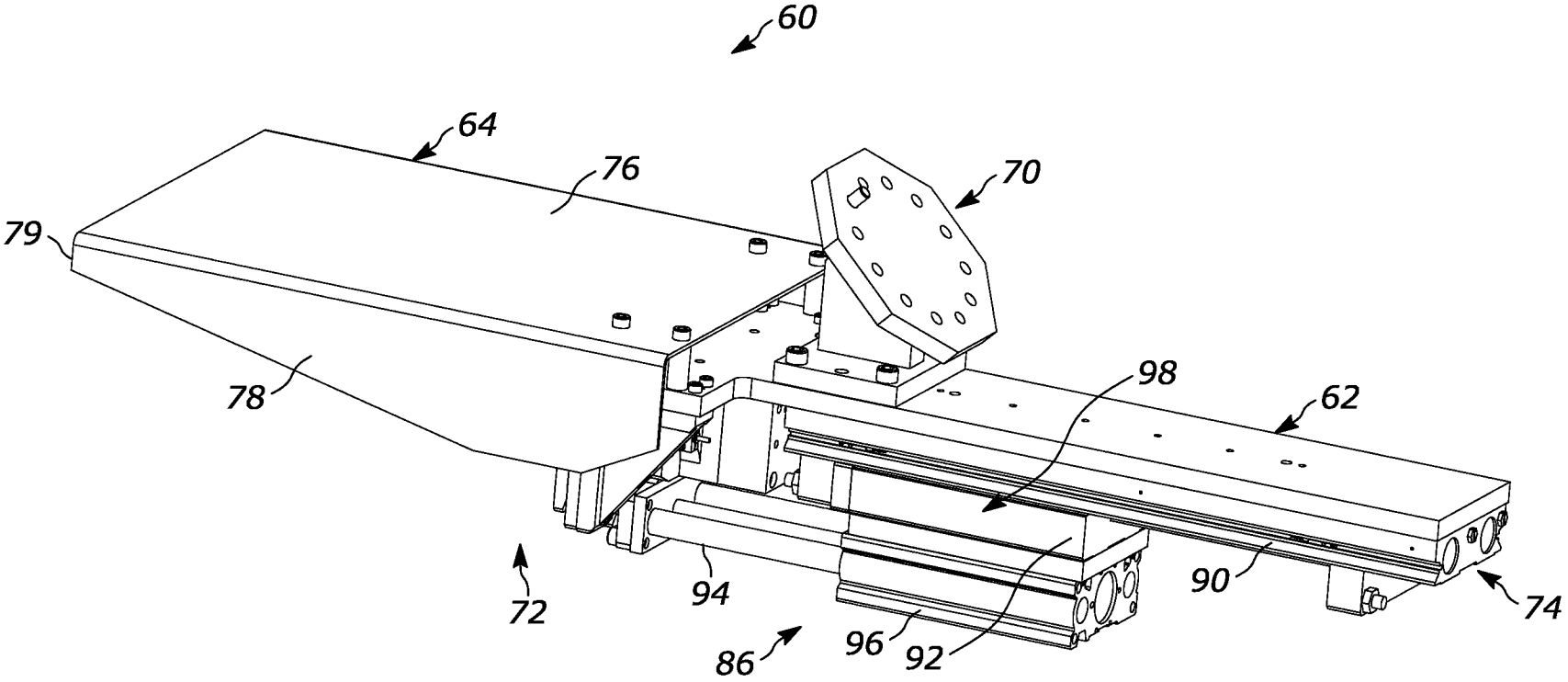
FIG. 8 of the drawings is a top, side, back perspective view of the tool of the tray transfer system of the item sorting system of the present disclosure.
Figure 9:
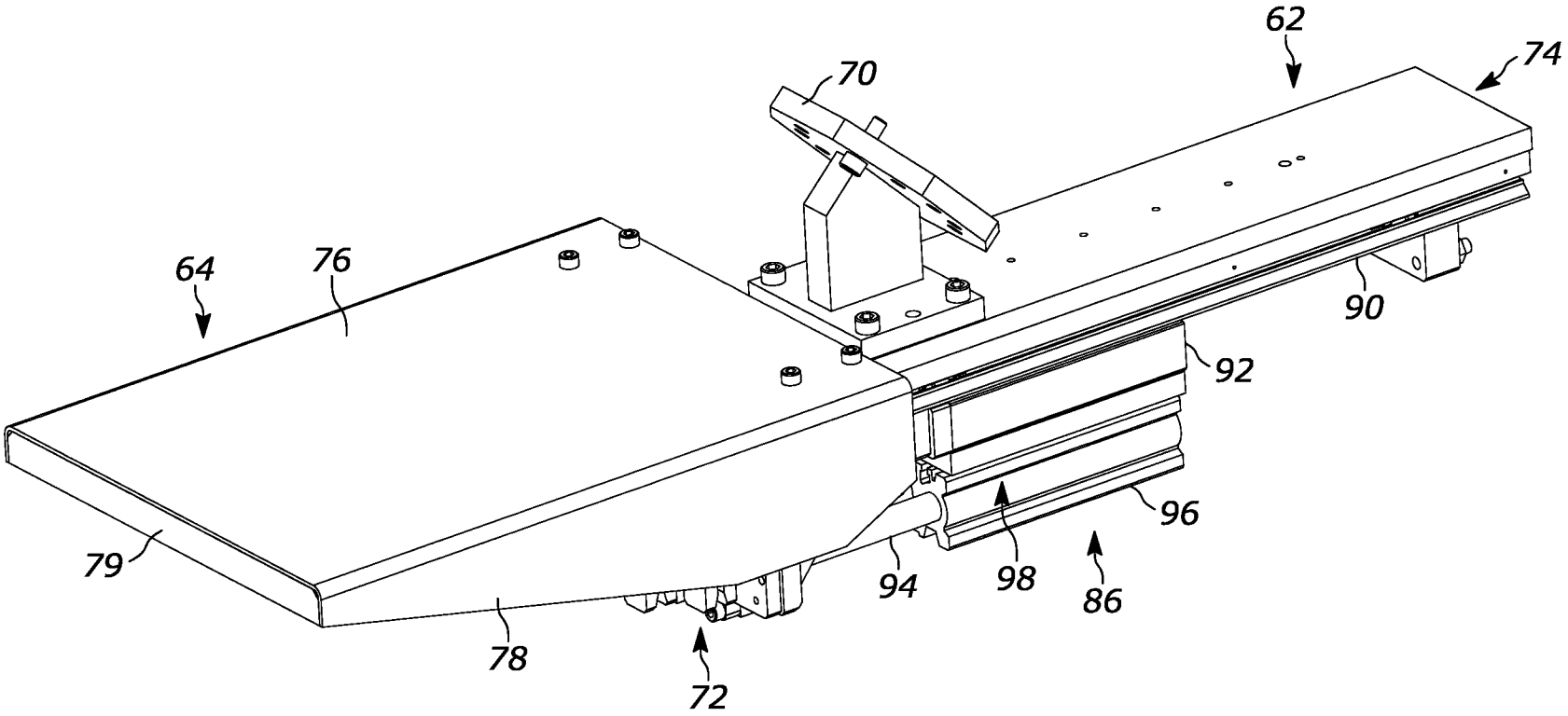
FIG. 9 of the drawings is a top, side, front perspective view of the tool of the tray transfer system of the item sorting system of the present disclosure.
Figure 10:
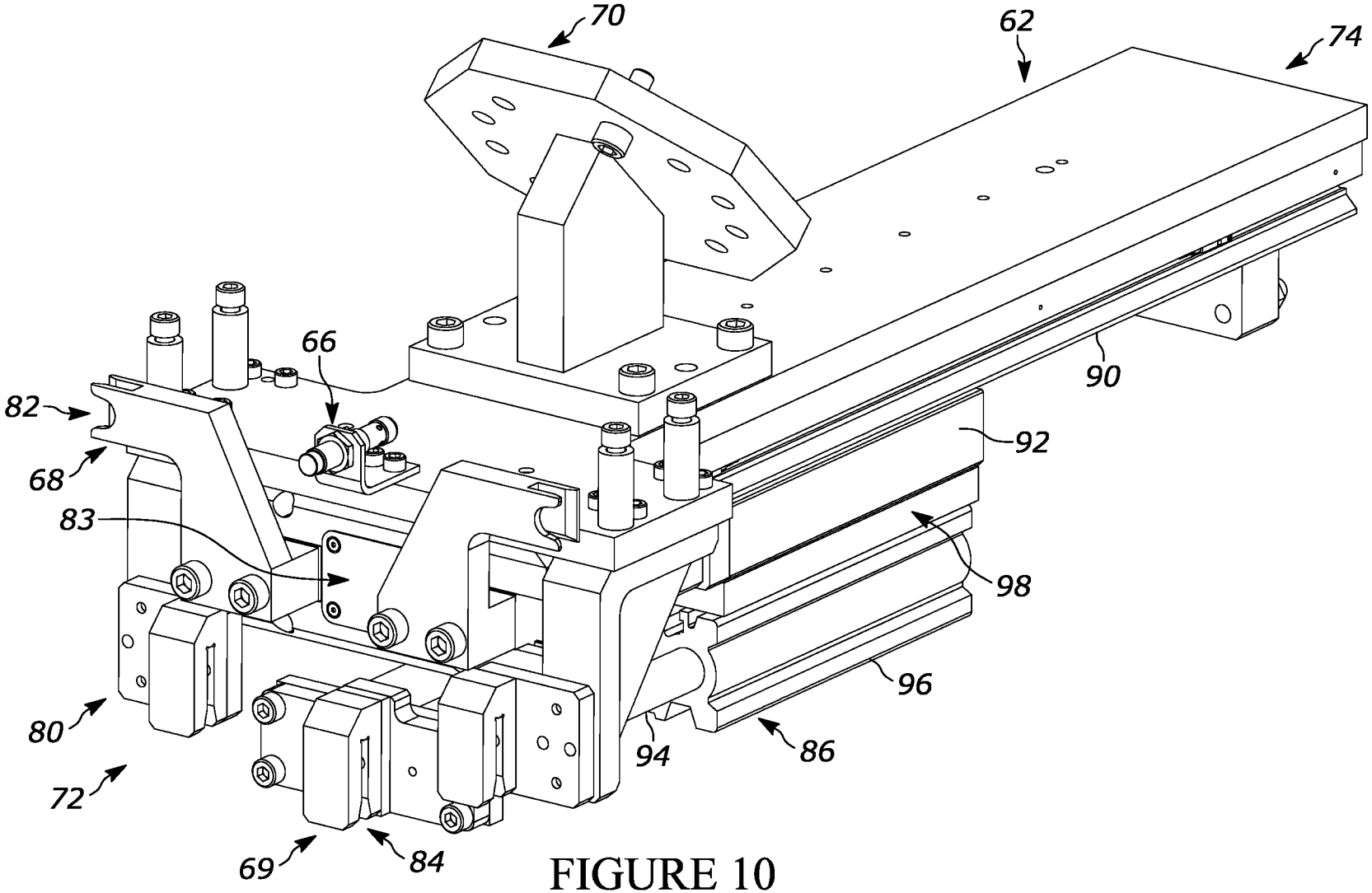
FIG. 10 of the drawings is a top, side, front perspective view of the tool of the tray transfer system of the item sorting system of the present disclosure, having the tray cover removed for pictorial clarity.
Figure 11:
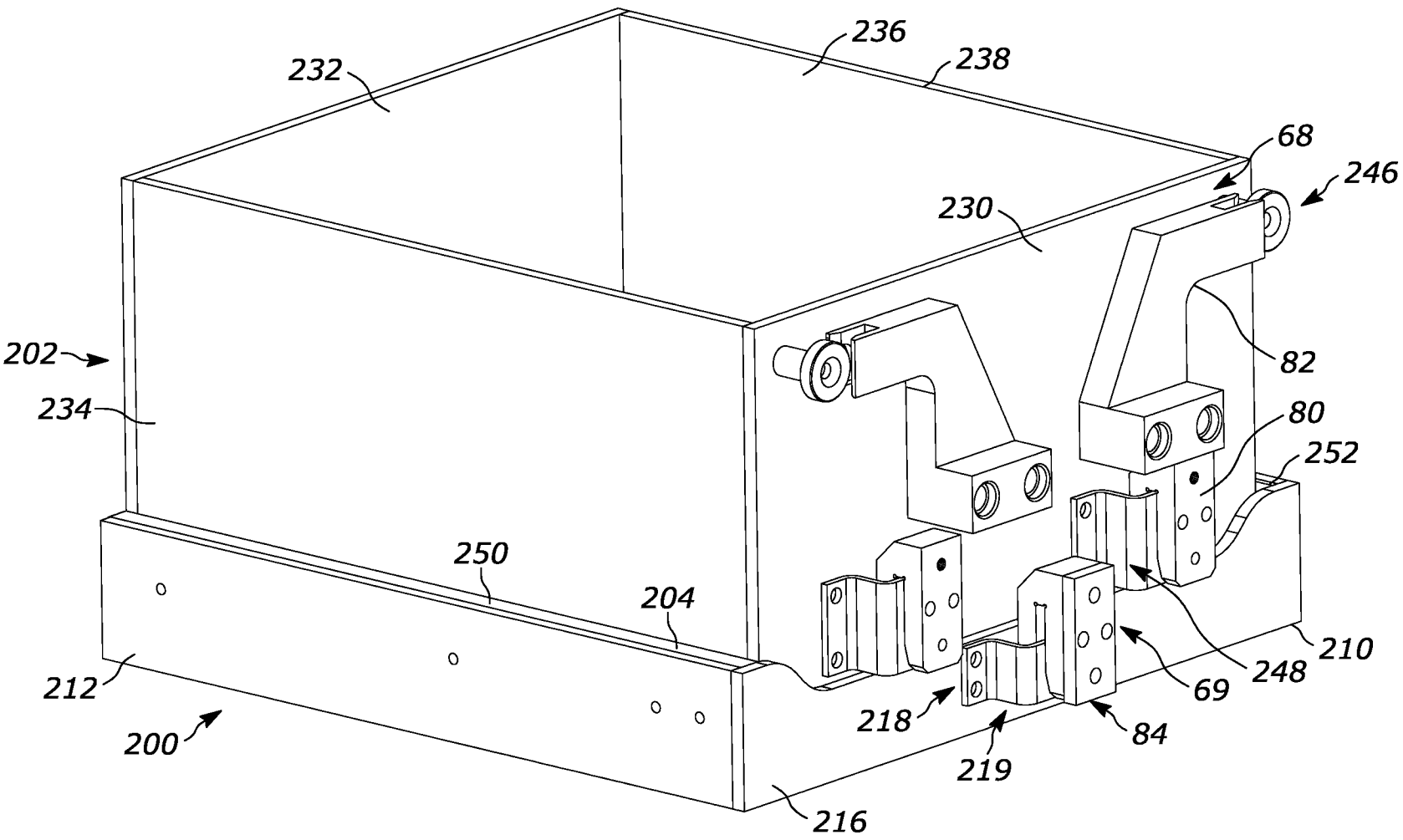
FIG. 11 of the drawings is a perspective view of the tray of the present disclosure, as retained by the retaining structures of the tool, and in particular, the upper tray attachment assembly and the lower tray attachment assembly.

The trays 18 utilized with the system are shown in FIGS. 6 and 7 as comprising lower portion 200, upper portion 202 and slidable coupling assembly 204. The lower portion and the upper portion are slidably movable relative to each other through the slidable coupling assembly 204. In the configuration shown, the tray generally comprises a rectangular cubic configuration with an open top. More particularly, the lower portion 200 includes base 210, first side wall 212, second side wall 214, front wall 216 and lower portion attachment member 218. The base 210 includes upper surface 220, lower surface 222, and back edge 224. The first side wall 212 includes inner surface 226. The second side wall 214 includes inner surface 228. The front wall includes outer surface 229. The lower portion attachment member comprises a stake pocket 219 defined in the front wall 216. In the configuration shown, the base is substantially rectangular with walls upstanding from three of the four sides of the rectangle. Of course, other configurations and dimensions are contemplated.

The upper portion 202 comprises front wall 230, back wall 232, first side wall 234, second side wall 236, and upper portion attachment assembly 239. The front wall 230 includes outer surface 240, the first side wall includes outer surface 242, the second side wall includes outer surface 244. The walls of the upper portion extend beyond an upper edge of the side walls and front wall of the lower portion 200, and terminate at an upper edge 238 which defines ingress and egress from the tray when the tray is assembled and the base 210 of the lower portion provides the bottom wall of the tray.

The upper portion attachment assembly 239 is configured to couple the upper portion to the tool 60 of the tray transfer system. The upper portion attachment assembly includes pins, such as pin 246, that are positioned proximate the upper edge of the upper portion. In the configuration shown, there are a pair of pins that are generally symmetrically positioned on and extend from the outer surface of the front wall 216.

The slidable coupling assembly, in the configuration shown, comprises a pair of drawer slides, one pair of which 250, slidably couples the first side wall 212 with the first side wall 234 about their respective adjoining surfaces 226 and 242. The second pair of the drawer slides 252 slidably couples the second side wall 214 with the second side wall 236 about respective surfaces 228, 244. It will be understood that the two drawer slides are positioned substantially in parallel so as to cooperatively allow for slidable movement.

Figure 5:
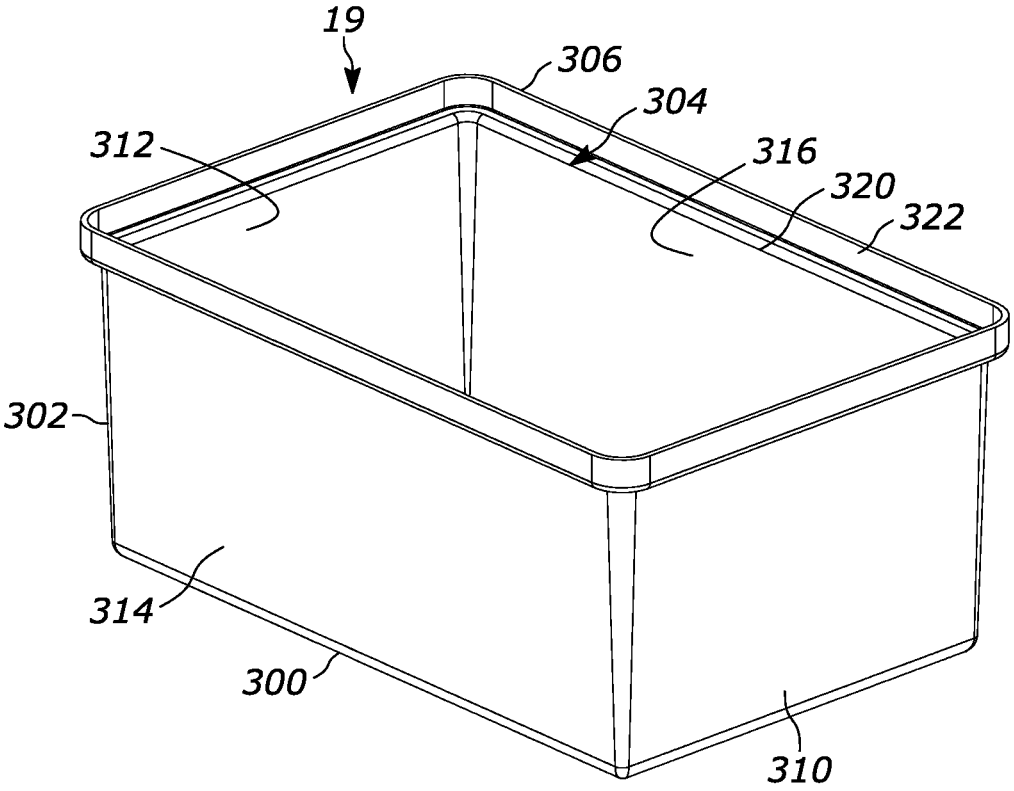
FIG. 5 of the drawings is a perspective view of an exemplary tote used with the item sorting system of the present disclosure, with the understanding that the tote is merely exemplary, and a number of different configurations are contemplated for the container that is termed a tote herein.

The tote 19 is shown in FIG. 5 as comprising a generally rectangular cubic configuration with outwardly opening sides. In particular, the tote 19 includes base 300, upstand 302, upper lip 304, culminating at top edge 306. The upstand extends from the base 300 in an upward and outward direction and includes front wall 310, back wall 312, first side wall 314, and, second side wall 316. The upper lip 304 includes outward flange 320 and upward flange 322. The outward flange generally extends outwardly and is substantially parallel to the base 300 and the upward flange generally extends upwardly and/or upwardly and outwardly.

Referring now to FIGS. 1 through 4, the tray handling system 12 includes tray conveying system 20, tray transfer system 50 and tray storage region 100. It will be understood that tray handling system moves the tray through the system and additionally transfers the contents of the tray to the totes. It will be understood that the tray handling system can interface with multiple cells (as explained above), or may be limited to a single cell. Additionally, the tray handling system may interface without outside tray handling systems so as to accomplish further automation and/or integration.

The tray conveying system 20 comprises a plurality of conveying elements (slides, rollers, belts, among other structures). In the present configuration, the tray conveying system 20 includes filling section 22, second conveyor section 26 and return conveyor section 28. The filling section 22 generally comprises a region that is configured to retain a tray for filling (with an item) by an operator (or by automated equipment). In the configuration shown, the filling region has room to maintain a plurality of trays in a side by side orientation. Various configurations are contemplated. The first conveyor section 24 includes first end 30 and second end 32. The first end 30 meets the filling region and the second end 32 meets the second conveyor section 26. In the configuration shown, the first conveyor section directs trays from the filling region along an incline so as to extend below the tote handling system 14, so as to reduce the footprint of the system. It is contemplated that the first conveying section can be spaced apart from the tote handling system, and it is not limited thereto.

The second conveyor section 26 is shown as extending generally perpendicular to the first conveyor section 24 at the second end 32 thereof. The second conveyor includes an entry 34, a queued region 36 and a tray pickup region 38. In the configuration shown, the entry region extends from the second end of the first conveyor, and the tray pickup region 38 defines the opposite end. In addition, the queued region 36, in the configuration shown, can be adapted to retain two trays, other configurations may have a larger or smaller queued region. Additional structures may be employed to transfer a tray from the first conveyor to the second conveyor.

Furthermore, in other configurations, it will be understood that the first conveyor can be extended so as to extend through to additional cells that are coupled to the cell shown (in a multi-cell configuration). There may be additional equipment, such as transfer structures or the like to direct a tray through the first cell or to the second conveyor section of the first cell.

The return conveyor section 28 is shown as comprising drop region 40 and end region 42. The drop region is proximate the robotic arm, so as to be easily accessible by the arm, and also proximate the tote handling system, to minimize the amount of movement and transfer time of travel after the tray has been emptied to the time it is placed on the return conveyor section. The end region 42 of the return conveyor section 28 leads into the filling section 22, and completes the circuit of movement for the tray through the cell and through the system.

It is contemplated that the conveyor sections may comprise belt conveyors (wherein a plurality of conveyors are associated with each other and each has a belt that has a length that is on the order of the width of the tray, or otherwise). In other configurations, powered rollers may be utilized. In still other configurations, a combination of a number of different types of conveyors, slides, or other movement structures may be employed, and the disclosure is not limited to any particular type of conveyor or any particular type of conveying structure. It is also contemplated that the conveyor system scans the tray and coordinates the item (that has been scanned) with the tray, so that an association has been created between the tray and the item. For example, each tray may have a bar code or the like as an identifier, and when the item is placed (and scanned) into the tray, the item and tray can be associated with each other.

Figure 2:
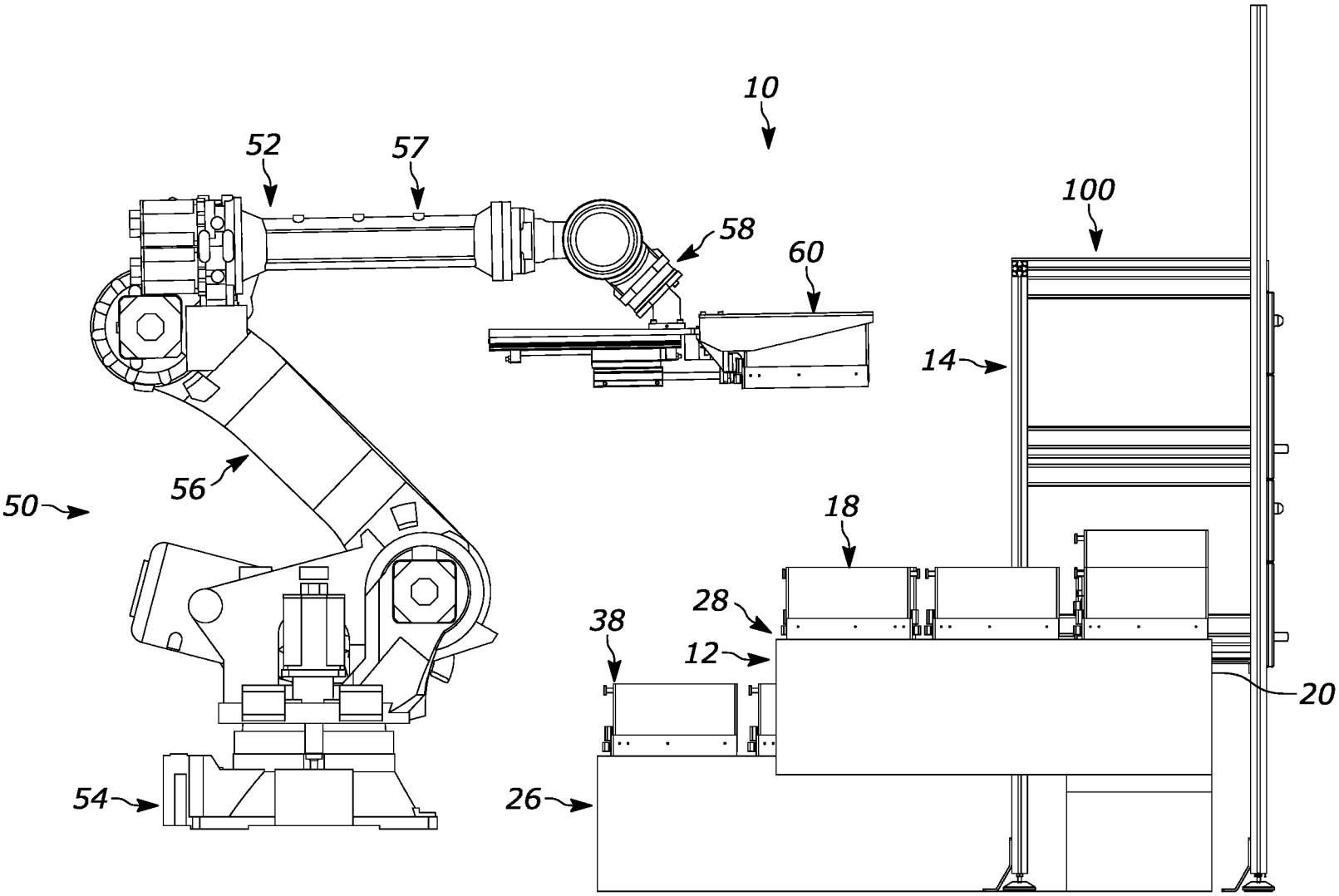
FIG. 2 of the drawings is a side elevational view of the item sorting system of the present disclosure.
Figure 3:
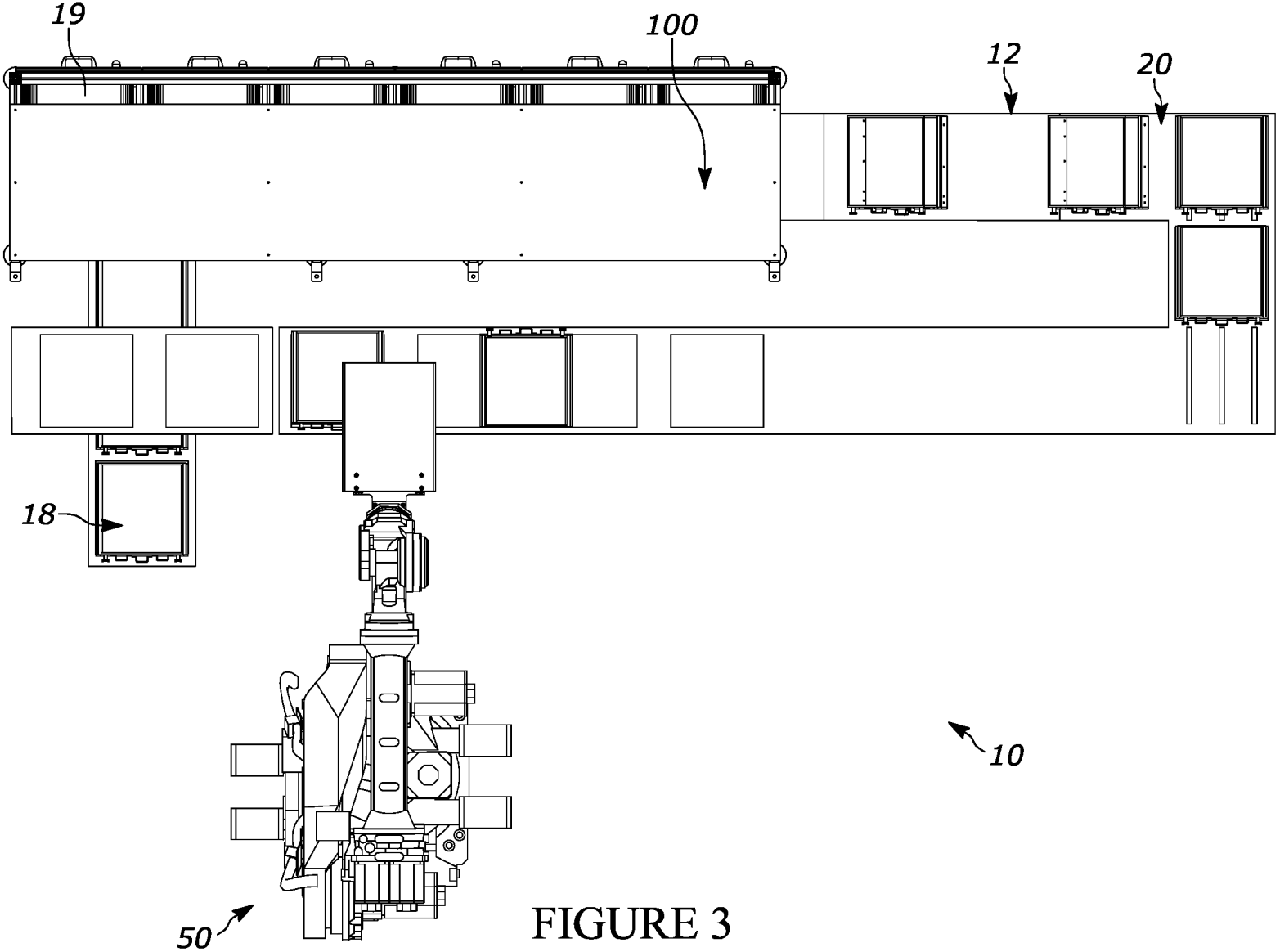
FIG. 3 of the drawings is a top plan view of the item sorting system of the present disclosure.

The tray transfer system 50 is shown in FIGS. 1 through 3 as comprising robot arm assembly 52 and tool 60. The robot arm assembly 52, in the configuration shown, comprises a six-axis robotic arm. Such arms generally include base 54 which is coupled to an outside surface, such as the floor, a first arm 56, a second arm 57 and a tool coupling portion 58. The first arm and the base are pivotably coupled together, and the entire structure can rotate about the base. The second arm and the first arm are pivotally coupled. The tool coupling portion 58 is pivotably and rotatably coupled to the second arm. The tool is coupled to the tool coupling portion. One robot arm that is contemplated for use comprises a Fanuc R200ic/165F available from Fanuc America Corporation—Fanuc CNC. Of course, others are contemplated, and such a robot is merely exemplary.

The tool 60 (often referred to as an end of arm tool in the automation and robotics sphere) is shown in greater detail in FIGS. 8 through 11. The tool 60 comprises frame 62, tray cover 64, tray sensor 66, upper tray attachment assembly 68 and lower tray attachment assembly 69. The frame 62 includes attachment plate 70 and extends from coupling end 72 to distal end 74. The attachment plate 70 is positioned on the top surface of the frame and is positioned between the coupling end 72 and the distal end 74. In the configuration shown, the attachment plate 70 is positioned on the top surface closer to the coupling end 72. The attachment plate can be fixedly coupled to the tool coupling portion 58 through a plurality of fasteners or the like so as to be removable.

The tray cover 64 comprises a generally planar material (such as a sheet metal or the like) that extends outwardly from the coupling end 72 of the frame. The tray cover 64 includes top wall 76, side walls 78 and front lip 79. The tray cover 64 generally matches the configuration of the upper edge 238 of the upper portion of the tray so as to effectively provide a cover over the tray when the tray is coupled thereto.

The tray sensor 66 is positioned proximate the coupling end 72 and can provide a signal that corresponds to the condition of a tray within the tool. That is, the tray sensor can identify whether or not a tray is positioned in the tool. A number of different types of sensors are contemplated, such as, for example, a proximity sensor or the like. In other configurations, a mechanical type of sensor is likewise contemplated.

The upper tray attachment assembly 68 is shown as comprising stakes 80 and articulated pin grasping arms 82. The stakes 80 are configured to engage the stake pockets 248 of the upper portion of the tray 18. The pin grasping arms 82 are configured to engage with the pins 246 of the upper portion attachment assembly 239 of the upper portion of the tray. The articulated pin grasping arms include actuator 83 which can selectively direct the pin grasping arms outwardly and inwardly to selectively engage and disengage the pins 246. It will be understood that with the pins and the pin grasping arms, the tray is locked into engagement (the upper portion thereof) with the tool and relative movement is precluded (whereas with the stakes, upward movement of the tool relative to the tray would disengage the same).

The lower tray attachment assembly 69 is shown as comprising stake 84 and slidable movement assembly 86. The stake is configured to engage the stake pocket 219 of the lower portion of the tray 18. The slidable movement assembly allows and facilitates the slidable movement of the lower portion of the tray relative to the upper portion of the tray while retained by the tool. The slidable movement assembly 86 includes first guide member 90, first engaging block 92, second guide member 94, second engaging block 96 and actuator 98. In the configuration shown, a double slider is utilized to increase speed and to shorten the footprint of the frame and the lower tray attachment assembly. Other slider mechanism are contemplated, some of which may involve only a single relative slider. The actuator may comprise any one of a number of different actuation mechanisms, and, the disclosure is not limited to any particular configuration of the actuator. Additionally, it will be contemplated that other actuation may be utilized, such as bomb bay doors, rotary actuation among others.

It will be understood that movement in a downward direction of the tool relative to the tray when the stake pockets and the stakes are aligned will direct the stakes into the stake pockets of the tray, thereby coupling the two structures together. And, the subsequent articulation of the pins by the articulated pin grasping arms locks the two structures together for collective movement.

The tray storage region 100 is shown as the region above the cubby array 120. As will be explained, where trays are received in particular orders, it may be desirable to for a short period of time to store a tray and then resume handling the tray. In such an instance, a tray can be positioned in the tray storage region 100 until handled again. By way of example, where a tote is to receive two items, a first item of a low density and a second item of a high density, and the tray with the low density item is delivered first, there is a risk of damaging the low density item if the low density item is placed into a tote, and the high density item is then placed on the tote on top of the low density item. In such an instance, it would be desirable to store the tray with the low density item in the tray storage region and then handle the high density item. Once the high density item is placed into the tote, the low density item, and the tray associated therewith can be removed from the tray storage region and handled by the system.

Figure 4:
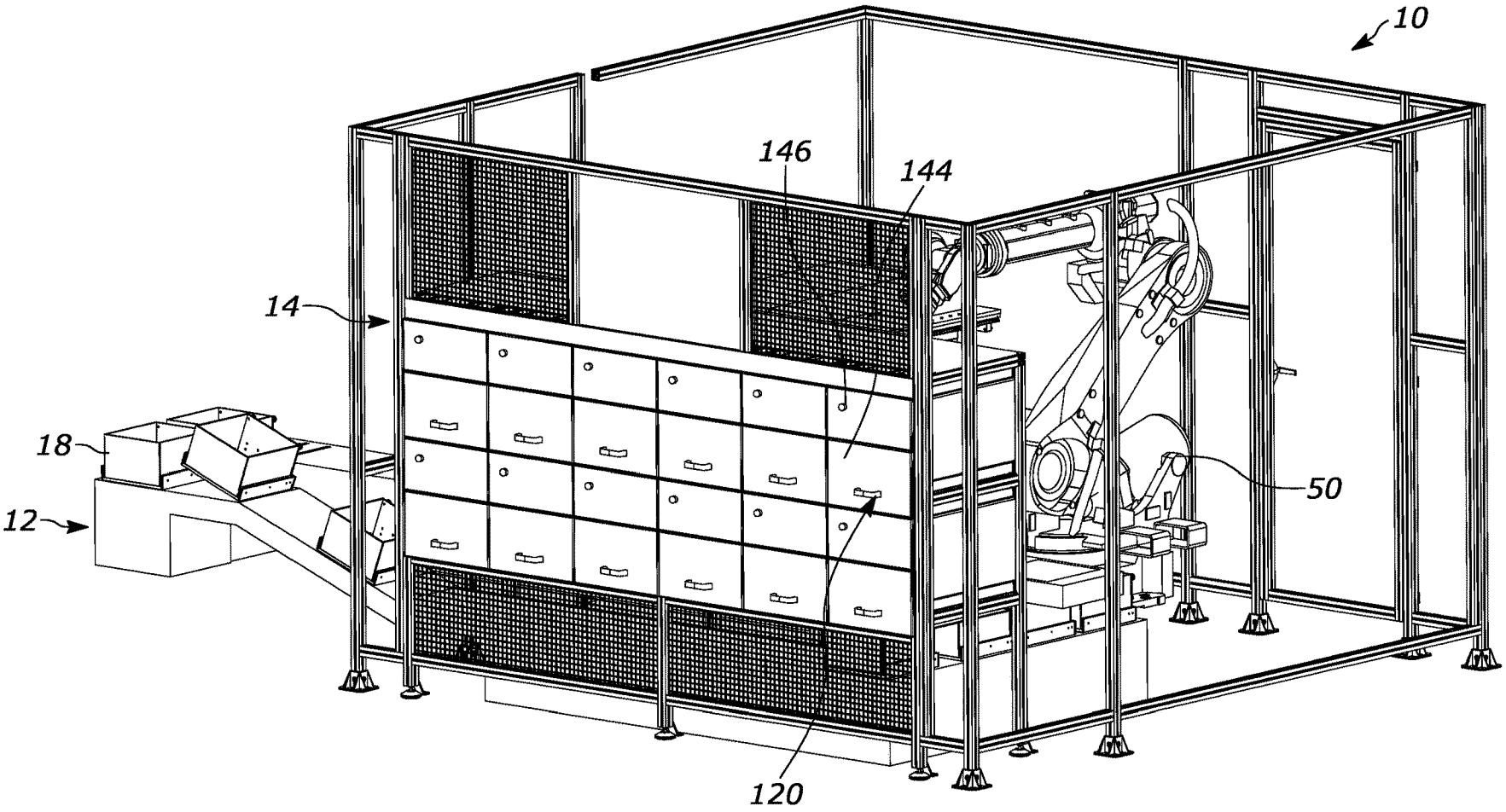
FIG. 4 of the drawings is a perspective view of a back side of the item sorting system of the present disclosure, showing, in particular, the tote handling system and the region where an operator would have access to the totes, as well as a frame surrounding the system, forming, for example, a cell.

The tote handling system 14 is shown in FIGS. 1 and 4 as comprising cubby array 120. The cubby array comprises a plurality of individual cubbies, such as cubby 120. In the configuration shown, the cubby array comprises a 2 by 6 array of cubbies. In the configuration shown, the cubby array is positioned along a single wall and in a linear configuration. Each of the cubbies is configured for access by an operator, and, as such, is positioned in regions that are easily accessible by an operator. In some configurations, the cubbies may be positioned, on a plurality of walls, in a plurality of locations. The particular configuration of the cubbies and the array of cubbies is merely exemplary, and, it is contemplated that the cubbies can be positioned as desired, preferably within desired reach of the robotic arm. Additionally, it is contemplated that there may be arrays of varying sizes, and that the disclosure is certainly not limited to a 2 by 6 array.

Figure 12:
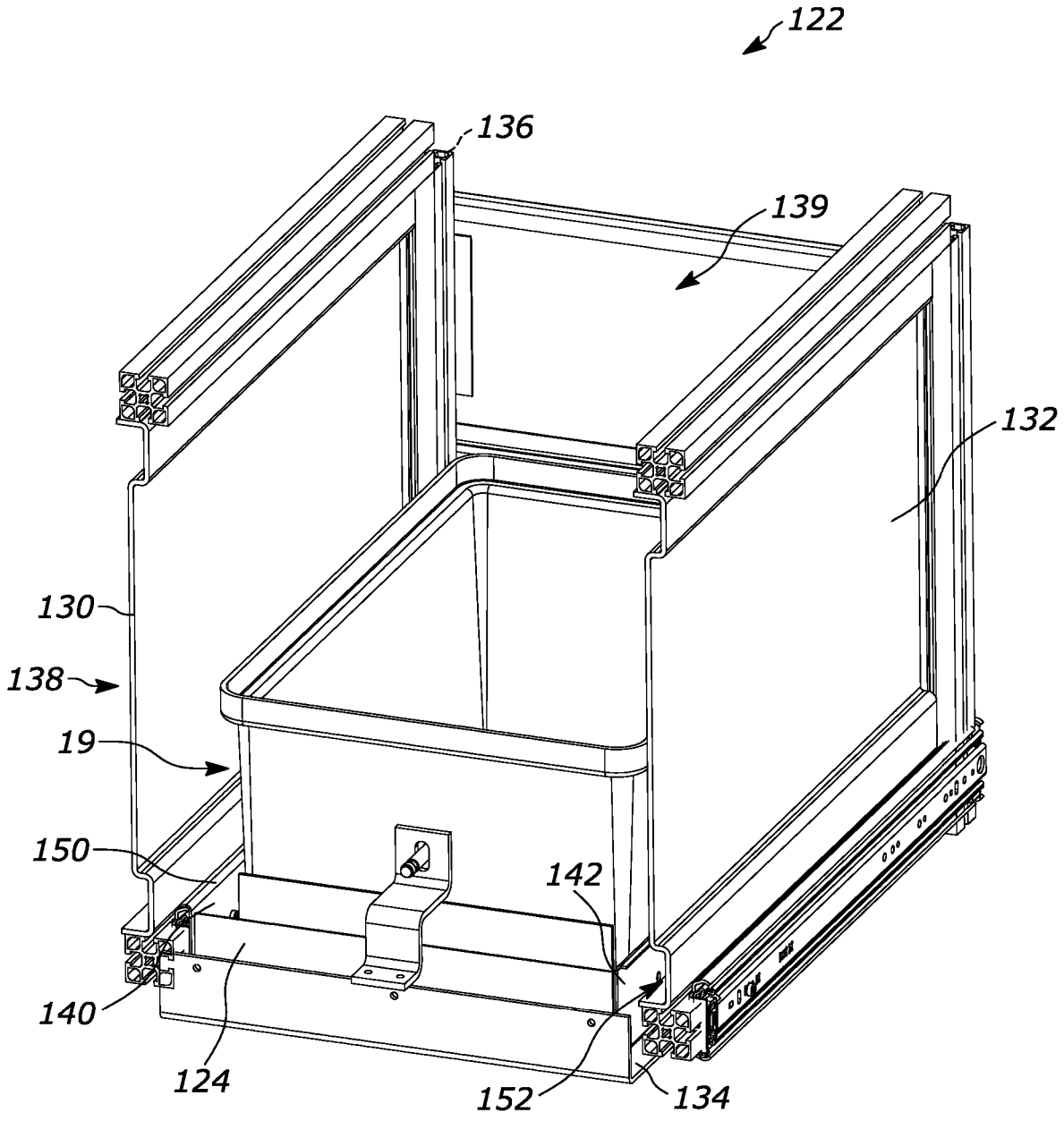
FIG. 12 of the drawings is a perspective view of a cubby of the cubby array of the present disclosure, having a tote positioned therein.
Figure 13:
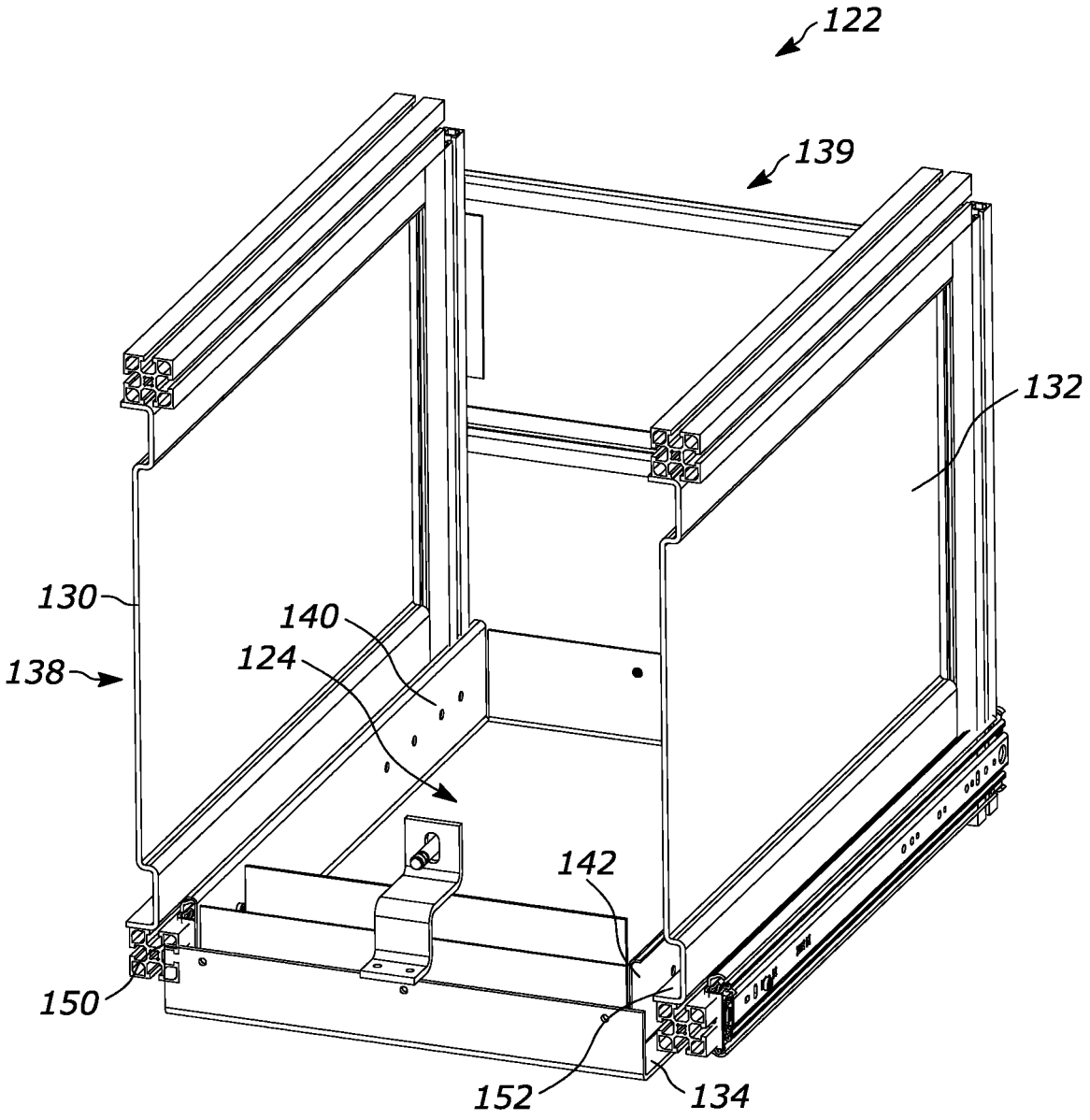
FIG. 13 of the drawings is a perspective view of the cubby of FIG. 12, with the tote removed therefrom.
Figure 14:
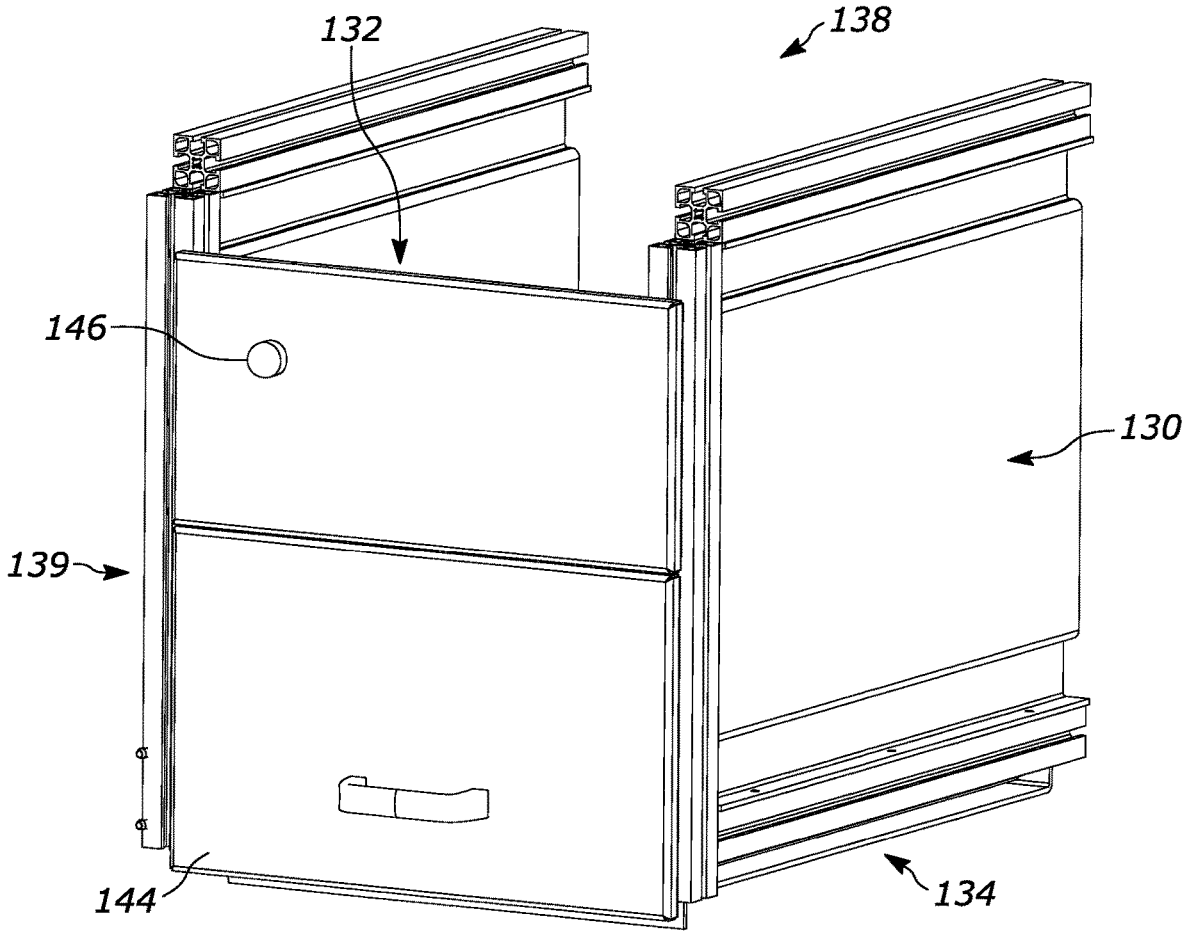
FIG. 14 of the drawings is a perspective view of the back of the cubby of FIG. 12, showing the door and the indicator associated therewith.

An exemplary cubby 122 is disclosed in FIGS. 12 through 14 as including the cubby configuration, a movable floor 124 and a floor coupling assembly 126. The cubby 122 includes a first side wall 130, a second side wall 132, bottom wall 134, top wall 136. An entry opening 138 is defined at one end, and an exit opening 139 is defined at the other end. A door 144 substantially covers the exit opening 139, and an indicator 146 (such as an indicator light or the like) can be positioned proximate the exit door to provide status of the contents of the cubby (i.e., tote is present, tote is ready for pickup by an operator, tote has tray within cubby, a quantity of items have been introduced into the tote, but not all items are in the tote, among others).

The movable floor 124 is shown as having a first upstand 140 and a second upstand 142 extending from each side edge. The movable floor 124 has a footprint that generally matches the bottom wall 134 of the cubby 122. The floor coupling assembly 126 includes a first side rail 150 and a second side rail 152. The opposing side rails cooperatively couple the upstands of the movable floor relative to the respective side walls to allow for the slidable movement of the movable floor relative to the cubby. In other configurations, the movable floor may be omitted, and an operator can reach inside of the cubby to place and/or retrieve a tote.

The operation of the system will be described with reference to the FIGS. 1 through 14, for structural features, and also with respect to the flowchart of FIG. 15 as to the manner in which items travel through the system, and the flowchart of FIG. 16 as to how the totes and contents are removed from the system for further processing.

Figure 15:
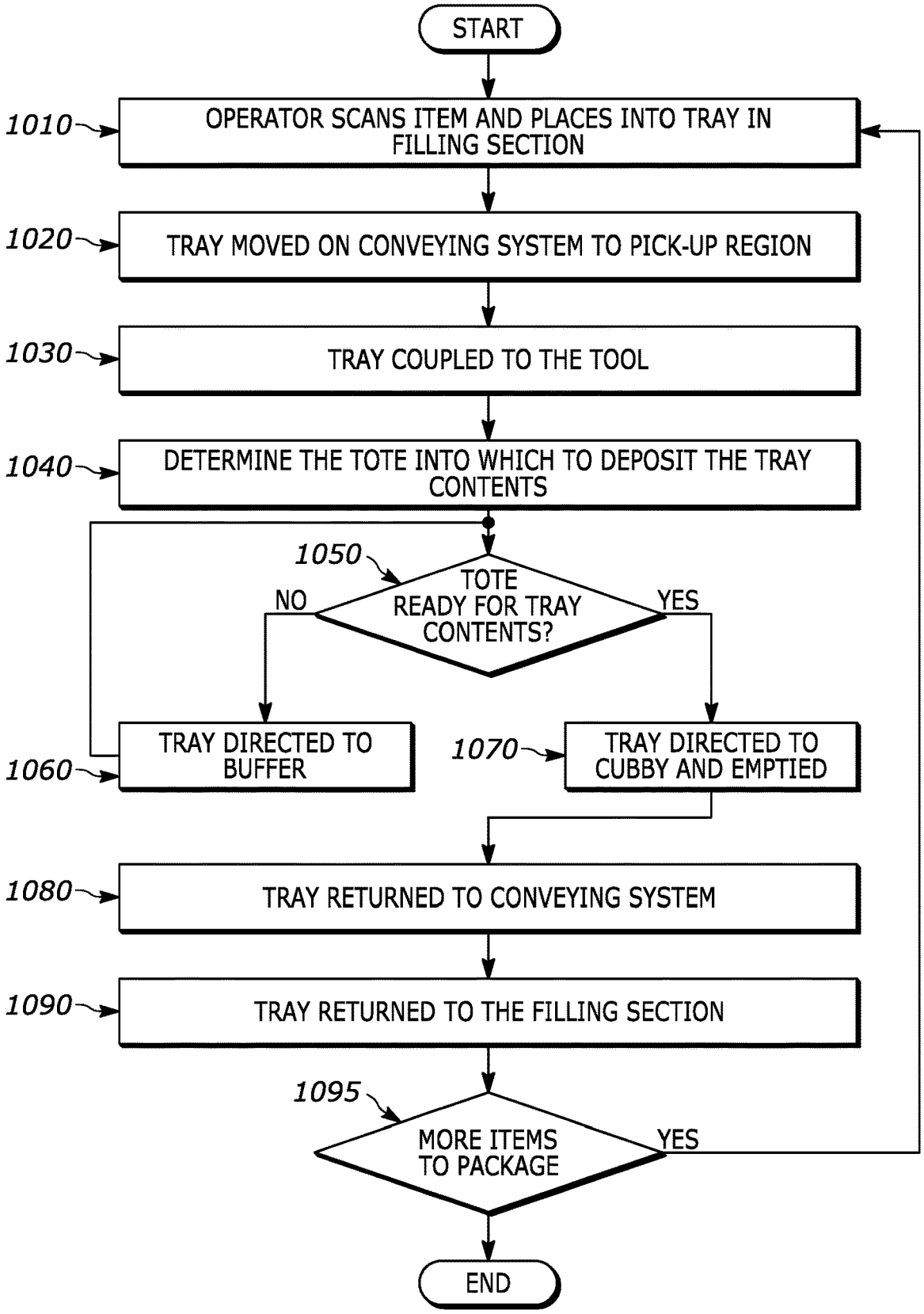
FIG. 15 of the drawings is a flowchart of an exemplary method of placing an item into the tote.

In operation, and with particular reference to FIG. 15, an operator proximate the filling region of the tray conveying system scans an item that has been presented to the operator. Once scanned, the operator drops the item into the tray, and, the tray is also scanned so that an association between the item and the tray can be established. At the same time, or at a time prior to or near handling the tray by the robot arm, the tray is associated with a tote. In other words, the system determines the tote into which the item in the tray is to be deposited. This is shown as occurring at step 1040, however, it will be understood that this step can be accomplished prior to step 1050 and prior to some of the other above-described steps.

At step 1020, the tray is moved along the conveying system to the pick-up region. In the configuration shown, the tray moves from the filling section, to the first conveyor section and then to the second conveyor section. Eventually, the tray proceeds along the second conveyor section to the pick-up region of the second conveyor section.

Once in position at the pick-up region, the robot arm is coupled to the tray. This is accomplished by directing the tool toward and into alignment with the tray. Once in alignment, the tool is moved in a downward direction relative to the tray, the stakes of the tool are directed into the stake pockets of the upper and lower portions of the tray. Once these have been mated, the actuator is triggered and the pin grasping arms are directed outwardly to releasably grasp the pins of the upper portion of the tray. Once these are engaged, the tray is fully secured to the tool and the tray is substantially precluded from separation with the tool upon movement of the tool.

Additionally, when the tray is properly retained by the tool, the tray cover extends over the upper edge of the tray to preclude contents from being inadvertently lost during the movement of the tray by the tool.

Next, to the extent that the proper association between the tray, the item and the tote has not been established, at step 1040, the proper tote is designated for which to receive the item that is in the tray. Additionally, at step 1050, a determination is made as to whether the tote is ready to accept the item from the tray. In some instances, as described above with respect to items of different (high versus low, for example) densities, it may be desirable to place the tray in a buffer region, or a storage region until the tote is ready to accept the item from the tray. If it is necessary to leave the tray in the buffer area, at step 1060, the tool can direct the tray to the tray storage region and then pick up the tray again when the tote is ready to accept the item in the tray.

When the tote is selected and the tote is ready to accept the item (i.e., contents) of the tray, at step 1070 the tool moves the tray to the appropriate tote. In particular, the tray is directed into the cubby that has the desired and identified tote. Once properly directed and inserted into the cubby, the tray is positioned so as to overlie the upper edge of the upper lip of the tote. In some configurations, the tray and the tote may abut, whereas in other configurations, they are in close proximity without abutting.

Once positioned in the proper orientation relative to the tote, the tray is ready to be emptied with the contents (i.e., the item) being moved from the tray into the tote. To accomplish such a transfer, in the configuration shown, the slidable movement assembly of the tool is activated wherein the tool slidably moves the lower portion of the tray relative to the upper portion of the tray thereby moving the lower portion of the tray from between the upper portion of the tray and the tote. As this occurs, the item (or contents) of the tray drop by way of gravity into the tote. As the tray cover extends over the top of the tray, the item will not bounce out of the tray and tote when dropped into the tote.

Once the contents have been deposited into the tote, the lower portion of the tray is slid back in its original position within the footprint of the upper portion, effectively separating the tray from the tote. At step 1080, the tray is then removed from the cubby and placed on the return conveyor section proximate or at the drop region thereof. It will be understood that the lower portion of the tray can be slid back into its original configuration as the tool is moving the tray from the cubby to the return conveyor section. It will be understood that the more operations that can be accomplished simultaneously and as the movement distances can be minimized, the system will generally have a higher throughput.

The tray then continues back to the filling section, wherein the tray goes through the same process. It will be understood that such a process can continue item after item after item as desired.

Figure 16:
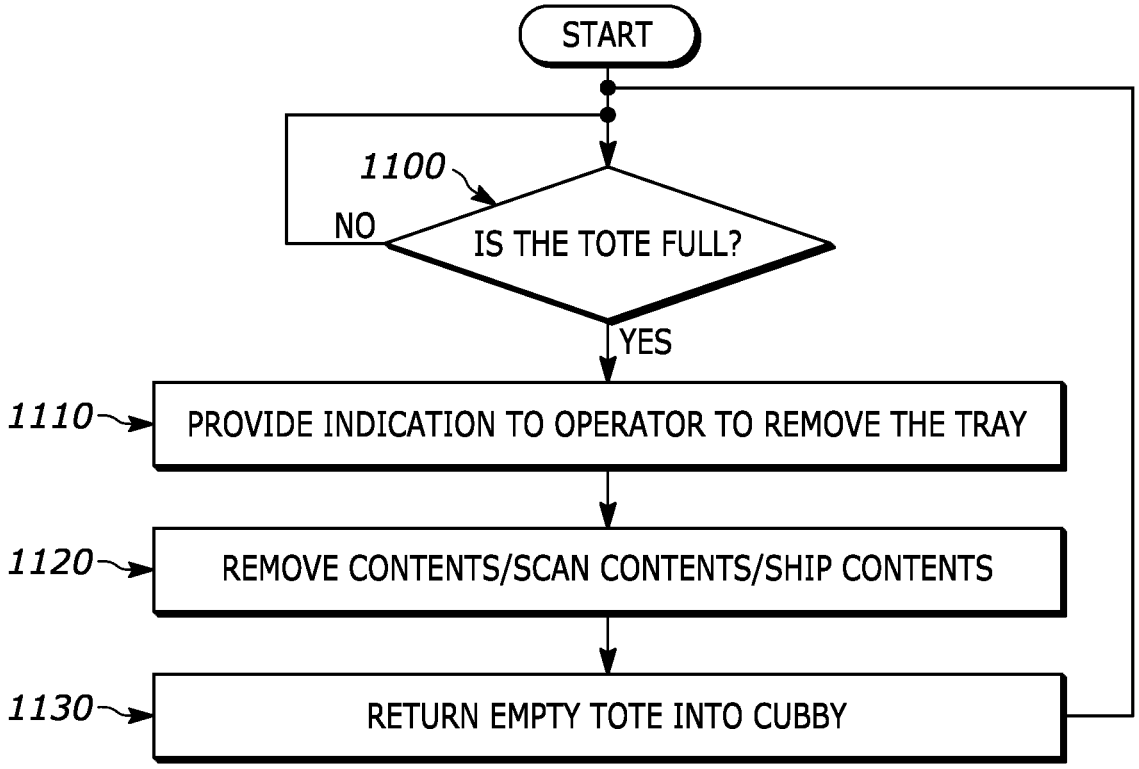
FIG. 16 of the drawings is a flowchart of an exemplary method of removing items and/or totes from the sorting system for further processing.

In conjunction with the system of providing items to the totes, with reference to FIG. 16, the system does have a method by which to remove the totes and the items in the totes from the system.

Specifically, with referenced to step 1100, as the system is receiving items and trays and items are being transferred from the trays to the respective totes, eventually a tote may be completed and no further items are to be deposited into the tote. For example, the system may be positioned in a fulfillment center and each tote represents a customer with the contents comprising the order of the customer. At some point, all of the ordered items have been pulled, provided to the user, deposited into trays and then transferred from the trays into the tote. And, the tote has all of the required items of the order.

At step 1100, therefore, the system signals that the tote is full (or complete, or the order is completed, or all of the items that were to be in the tote have been delivered). Once the full signal is received, an indication can be provided to another user proximate the tote handling assembly that the tote is ready for handling outside of the system. For example, the indicator may comprise a light or lamp that is illuminated and that indicator corresponds to a particular cubby.

At step 1120, the operator can open the door of the cubby and slide out the movable floor so as to have access to the tote. The tote can then be removed, or the contents of the tote can be removed. The removed contents can then be scanned and placed into a shipping container.

At step 1130, the operator can replace an empty tote into the cubby and the tote can be indicated to the system as empty and ready to accept items. The process is then repeated.

It will be understood that a number of variations, in addition to the variations above are contemplated in the system. For example, the totes are shown to comprise a tote of a particular dimension and configuration. It is contemplated that the totes may comprise structures that are larger and smaller and of vastly different configurations. For example, the totes may comprise gaylords, pallet size packaging containers, mail sorting containers, mail bags, as well as packaging that can be shipped without transfer into another shipping container, i.e., a final delivery container.

It will further be understood, and is explained above that multiple cells can be combined, wherein the trays may be directed to one of a plurality (i.e., 2, 3 or more) robotic arms, each of which is configured to move the items in trays presented thereto to a plurality of totes in cubbies, or other totes of various sizes.

It will further be understood that the system is configured for use in association with any number of different items. For example, such items may be grocery items, or drug store items, for example. It will also be understood that due to the configuration of the tray and the tote and the transfer between the tray and the tote, items of all shapes and sizes can be transferred, for example, including, round, cylindrical and other items that can roll, shift and/or slide along a surface as the surface is being moved. It will further be understood that the items may comprise packages or already boxed items.

It will further be understood that the system can be monitored either directly or remotely, through any number of different interfaces, including, but not limited to computers, tablets and smart phones. That is, one can monitor the health of the system and the parameters/performance of the system.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. An item sorting system comprising:

a tray handling system including a tray conveying system defining a conveyor having a filling region, a pick-up region and a return region;

a tray transfer system having a robotic arm assembly and a tray handling tool wherein the tray handling tool is positioned at an end of the robotic arm, the tray handling tool structurally configured to retain a tray;

a tote handling system including at least one cubby structurally configured to retain a tote;

wherein the tray handling tool can move between a pick-up region and the at least one cubby;

wherein the tray handling tool can be positioned within the at least one cubby; and wherein the tray handling tool further comprises an upper tray attachment assembly and a lower tray attachment assembly, wherein the lower tray attachment assembly can be moved relative to the upper tray attachment assembly when the tray handling tool is positioned within the at least one cubby.

2. The item sorting system of claim 1 wherein the at least one cubby has an entry opening and an exit opening opposite the entry opening, with the robotic arm having access to the entry opening.

3. The item sorting system of claim 1 wherein the at least one cubby comprises a cubby array having at least a plurality of rows and a plurality of columns of cubbies.

4. The item sorting system of claim 1 wherein the conveyor further includes a queued region within which the pick-up region is defined.

5. A tool for use in association with a robot arm for item sorting, the tool comprising:

a frame attachable to a robot arm, an upper tray attachment assembly coupled to the frame; and a lower tray attachment assembly coupled to the frame, wherein the upper tray attachment assembly and the lower tray attachment assembly are slidably relative to each other.

6. The tool of claim 5 wherein:

the upper tray attachment assembly includes:

at least one slot engaging prong structurally configured to releasably couple with an upper portion of a tray;

the lower tray attachment assembly includes:

at least one lower slot engaging prong structurally configured to releasably couple with a lower portion of a tray; and a slidable movement assembly, the slidable movement assembly including an actuator coupled to at least one lower slot engaging prong, so as to slidably move the lower tray attachment assembly relative to the upper tray attachment assembly.

7. The tool of claim 6 wherein the slidable movement assembly includes at least one guide that is coupled to the at least one slot engaging prong and to the actuator.

8. The tool of claim 6 wherein the upper tray attachment assembly includes opposing articulated pin grasping arms movable by an actuator, the articulated pin grasping arms structurally configured to releasably couple with pins of the upper portion of the tray.

9. The tool of claim 8 wherein the articulated pin grasping arms extend inwardly and outwardly in a direction that is perpendicular to the slidable movement of the upper tray attachment assembly relative to the lower tray attachment assembly.

10. The tool of claim 5 further comprising a tray cover extending from the upper tray attachment assembly and fixed thereto.

11. The tool of claim 10 wherein the tray cover includes a top wall, opposing side walls depending from the top wall and a front lip depending from the top wall spanning between the opposing side walls.

12. A tray for an item sorting system comprising:

an upper portion defined by a front wall, a back wall and a plurality of sidewalls defining a cavity with an upper opening and a lower opening;

a lower portion including a base that can extend over the lower opening to preclude the passage of an object therethrough;

a slidable coupling assembly coupled to each of the upper portion and the lower portion to enable slidable movement of the upper portion relative to the lower portion.

13. The tray of claim 12 further comprising:

a lower portion attachment member structurally configured to engage a lower tray attachment assembly;

an upper portion attachment member structurally configured to engage an upper tray attachment assembly.

14. The tray of claim 13 wherein the lower portion attachment member comprises a slot.

15. The tray of claim 13 wherein the upper portion attachment member comprises one of a slot and at least one pin.

16. The tray of claim 15 wherein the upper portion attachment member comprises each one of a slot and a pair of spaced apart pins extending from the front wall.

17. The tray of claim 12 wherein the lower portion further includes opposing sidewalls and a front wall, with the opposing sidewalls overlying the plurality of sidewalls of the upper portion of the tray and the front wall overlying the front wall of the upper portion.

* * * * *